US008753459B2

(12) United States Patent
Provost et al.

(10) Patent No.: US 8,753,459 B2
(45) Date of Patent: Jun. 17, 2014

(54) NEEDLING LOOPS INTO CARRIER SHEETS

(75) Inventors: George A. Provost, Litchfield, NH (US); James R. Barker, Francestown, NH (US)

(73) Assignee: Velcro Industries B.V., Willemstad, Curacao ( * ) Notice: Subject to any disclaimer, the term of this patent is extended or adjusted under 35 U.S.C. 154(b) by 1092 days.

(21) Appl. No.: 12/133,945

(22) Filed: Jun. 5, 2008

(65) Prior Publication Data

US 2009/0203280 A9 Aug. 13, 2009

Related U.S. Application Data

(63) Continuation-in-part of application No. 11/102,455, filed on Apr. 8, 2005, now abandoned, which is a continuation-in-part of application No. 10/728,138, filed on Dec. 3, 2003, now Pat. No. 7,156,937.

(60) Provisional application No. 60/430,731, filed on Dec. 3, 2002, provisional application No. 60/942,613, filed on Jun. 7, 2007.

(51) Int. Cl.
*A44B 18/00* (2006.01)

(52) U.S. Cl.
CPC ..... *A44B 18/0011* (2013.01)
USPC ..... 156/72; 156/148

(58) Field of Classification Search
None
See application file for complete search history.

(56) References Cited

U.S. PATENT DOCUMENTS

| | | | |
|---|---|---|---|
| RE18,001 E | 3/1931 | Rayner | |
| 2,706,324 A | 4/1955 | Cogovan | |
| 3,047,444 A | 7/1962 | Harwood | 428/153 |

(Continued)

FOREIGN PATENT DOCUMENTS

| | | |
|---|---|---|
| DE | 101 39 842 A1 | 4/2003 |
| EP | 0 341 993 A1 | 11/1989 |

(Continued)

OTHER PUBLICATIONS

Website: http://www.inda.org/pubs/c-papers/np00-toc.html. Inda.org, Needlepunch 2000 conference paper listing, retrieved Sep. 24, 2007. 2 Pages.

(Continued)

*Primary Examiner* — Barbara J Musser
(74) *Attorney, Agent, or Firm* — Fish & Richardson P.C.

(57) ABSTRACT

Methods of making a sheet-form loop product are provided. One method includes placing a layer of staple fibers against a first side of a substrate comprising a nonwoven web; needling fibers of the layer through the substrate by penetrating the substrate with needles that drag portions of the fibers through the substrate, leaving exposed loops of the fibers extending from a second side of the substrate; and anchoring fibers forming the loops by fusing the fibers to each other and to filaments of the nonwoven web on the first side of the substrate, while substantially preventing fusion of the fibers on the second side of the substrate. Sheet-form loop products are also provided, including for example a flexible nonwoven substrate and a layer of staple fibers disposed on a first side of the substrate, exposed loops of the fibers extending from a second side of the substrate, with bases of the loops being anchored on the first side of the substrate, wherein the fibers on the first side of the substrate are fused together to a relatively greater extent than the fibers on the second side of the substrate.

20 Claims, 7 Drawing Sheets

(56) References Cited

U.S. PATENT DOCUMENTS 3,348,992 A 10/1967 Cochran, II
3,408,417 A 10/1968 Sogawa et al.
3,496,260 A 2/1970 Guenther et al.
3,535,178 A 10/1970 Parlin et al.
3,577,607 A 5/1971 Ikoma et al.
3,674,618 A 7/1972 Spann
3,694,867 A 10/1972 Stumpf
3,704,191 A 11/1972 Buresh et al.
3,705,065 A 12/1972 Stumpf
3,708,361 A 1/1973 Stumpf
3,819,462 A 6/1974 Starr et al.
3,822,162 A 7/1974 Stumpf
3,940,525 A 2/1976 Ballard
3,949,128 A 4/1976 Ostermeier
3,950,587 A 4/1976 Colijn et al.
4,001,472 A 1/1977 Thomas et al.
4,010,302 A 3/1977 Anderson et al.
4,035,533 A 7/1977 Chambley
4,116,892 A 9/1978 Schwarz
4,131,704 A 12/1978 Erickson et al.
4,154,885 A 5/1979 Tecl et al.
4,154,889 A 5/1979 Platt
4,192,086 A 3/1980 Sichak
4,223,059 A 9/1980 Schwarz
4,258,094 A * 3/1981 Benedyk ..... 428/85
4,258,097 A 3/1981 Benedyk
4,295,251 A 10/1981 Tatham et al.
4,315,965 A 2/1982 Mason et al.
4,320,167 A 3/1982 Wishman
4,324,824 A 4/1982 Narens et al.
4,342,802 A 8/1982 Pickens, Jr. et al.
4,363,845 A 12/1982 Hartmann
4,377,889 A 3/1983 Tatham et al.
4,379,189 A 4/1983 Platt
4,389,442 A 6/1983 Pickens, Jr. et al.
4,389,443 A 6/1983 Thomas et al.
4,391,866 A 7/1983 Pickens, Jr. et al.
4,418,104 A 11/1983 Kiyomura et al.
4,439,476 A * 3/1984 Guild ..... 428/96
4,446,189 A 5/1984 Romanek
4,451,314 A 5/1984 Knoke et al.
4,451,315 A 5/1984 Miyazaki
4,490,425 A 12/1984 Knoke et al.
4,521,472 A 6/1985 Gold
4,536,439 A 8/1985 Forsten
4,600,605 A 7/1986 Nakai et al.
4,600,618 A 7/1986 Raychok, Jr. et al.
4,609,581 A 9/1986 Ott
4,645,699 A 2/1987 Neveu
4,654,246 A 3/1987 Provost et al.
4,750,443 A 6/1988 Blaustein et al.
4,761,318 A 8/1988 Ott et al.
4,770,917 A 9/1988 Tochacek et al.
4,931,343 A 6/1990 Becker et al.
4,973,326 A 11/1990 Wood et al.
5,032,122 A 7/1991 Noel et al.
5,066,289 A 11/1991 Polski
5,080,951 A 1/1992 Guthrie ..... 428/85
5,144,730 A 9/1992 Dilo
5,216,790 A * 6/1993 Eschenbach ..... 28/112
5,254,194 A 10/1993 Ott et al.
5,256,231 A 10/1993 Gorman et al.
5,265,954 A * 11/1993 Keil ..... 312/405
5,304,162 A 4/1994 Kuen
5,307,616 A 5/1994 Goineau et al.
5,320,890 A 6/1994 Anton et al.
5,326,612 A 7/1994 Goulait
5,379,501 A 1/1995 Goineau
5,380,313 A 1/1995 Goulait et al.
5,380,580 A 1/1995 Rogers et al.
5,382,461 A 1/1995 Wu
5,383,872 A 1/1995 Roessler et al.
5,386,595 A 2/1995 Kuen et al.
5,391,424 A 2/1995 Kolzer
5,403,302 A 4/1995 Roessler et al.
5,407,439 A 4/1995 Goulait
5,407,722 A 4/1995 Peake, III et al.
5,417,902 A 5/1995 Bennie et al.
5,423,789 A 6/1995 Kuen
5,447,590 A 9/1995 Gilpatrick
5,449,530 A 9/1995 Peake, III et al.
5,459,991 A 10/1995 Nabeshima et al.
5,470,417 A 11/1995 Goulait
5,476,702 A 12/1995 Datta et al.
5,500,268 A 3/1996 Billarant
5,518,795 A 5/1996 Kennedy et al.
5,531,732 A 7/1996 Wood
5,542,942 A 8/1996 Kline et al.
5,547,531 A 8/1996 Allen et al.
5,554,239 A 9/1996 Datta et al.
5,569,233 A 10/1996 Goulait
5,571,097 A 11/1996 Seth
5,595,567 A 1/1997 King et al.
5,599,601 A 2/1997 Polski et al.
5,603,708 A 2/1997 Seth
5,605,729 A 2/1997 Mody et al.
5,611,789 A 3/1997 Seth
5,611,791 A 3/1997 Gorman et al.
5,614,232 A 3/1997 Torigoe et al.
5,614,281 A 3/1997 Jackson et al.
5,615,460 A 4/1997 Weirich et al.
5,616,155 A 4/1997 Kronzer
5,616,394 A 4/1997 Gorman et al.
5,620,779 A 4/1997 Levy et al.
5,622,578 A 4/1997 Thomas
5,624,427 A 4/1997 Bergman et al.
5,630,896 A * 5/1997 Corbin et al. ..... 156/72
5,643,397 A 7/1997 Gorman et al.
5,647,864 A 7/1997 Allen et al.
5,654,070 A 8/1997 Billarant
5,660,911 A 8/1997 Tesch
5,669,900 A 9/1997 Bullwinkel et al.
5,669,901 A 9/1997 LaFortune et al.
5,685,756 A 11/1997 Noda
5,686,163 A 11/1997 Tsubata et al. ..... 428/99
5,692,949 A 12/1997 Sheffield et al.
5,699,593 A 12/1997 Jackson
5,707,707 A 1/1998 Burnes et al.
5,707,906 A 1/1998 Eschenbach
5,722,968 A 3/1998 Datta et al.
5,732,453 A 3/1998 Dilo et al.
5,736,214 A 4/1998 Billarant
5,759,926 A 6/1998 Pike et al.
5,763,041 A 6/1998 Leak et al.
5,766,723 A 6/1998 Oborny et al. ..... 428/100
5,773,120 A 6/1998 Deka et al.
5,786,060 A 7/1998 Takahashi et al.
5,814,390 A 9/1998 Stokes et al.
5,830,298 A 11/1998 Jackson
5,843,057 A 12/1998 McCormack
5,858,515 A 1/1999 Stokes et al.
5,866,222 A 2/1999 Seth et al.
5,888,607 A 3/1999 Seth et al.
5,891,547 A * 4/1999 Lawless ..... 428/92
5,904,793 A 5/1999 Gorman et al.
5,931,823 A 8/1999 Stokes et al.
5,945,131 A 8/1999 Harvey et al.
5,945,215 A 8/1999 Bersted et al.
5,962,102 A 10/1999 Sheffield et al.
5,962,112 A 10/1999 Haynes et al.
5,964,742 A 10/1999 McCormack et al.
5,997,981 A 12/1999 McCormack et al.
6,051,094 A 4/2000 Melbye et al.
6,086,984 A 7/2000 DiMaggio, Jr. et al.
6,093,665 A 7/2000 Sayovitz et al.
6,129,879 A 10/2000 Bersted et al.
6,129,964 A 10/2000 Seth
6,158,097 A 12/2000 Dilo
6,161,269 A 12/2000 Dilo et al.
6,162,522 A 12/2000 Deka et al. ..... 428/99
6,192,556 B1 2/2001 Kikko et al.
6,195,850 B1 3/2001 Melbye et al.
6,265,053 B1 7/2001 Kronzer et al.
6,329,016 B1 12/2001 Shepard et al.

(56) References Cited

U.S. PATENT DOCUMENTS

| | | | | |
|---|---|---|---|---|
| 6,342,285 | B1 | 1/2002 | Shepard et al. | |
| 6,355,759 | B1 | 3/2002 | Sherman et al. | |
| 6,368,444 | B1 | 4/2002 | Jameson et al. | |
| 6,410,138 | B2 | 6/2002 | Mleziva et al. | |
| 6,454,989 | B1 | 9/2002 | Neely et al. | |
| 6,489,004 | B1 | 12/2002 | Martin et al. | |
| 6,537,935 | B1 | 3/2003 | Seth et al. | |
| 6,598,276 | B2 | 7/2003 | Shepard et al. | |
| 6,638,611 | B2 | 10/2003 | Seth | |
| 6,642,160 | B1 | 11/2003 | Takahashi | |
| 6,642,429 | B1 | 11/2003 | Carter et al. | |
| 6,645,611 | B2 | 11/2003 | Seth | |
| 6,660,202 | B2 | 12/2003 | Shepard et al. | |
| 6,686,303 | B1 | 2/2004 | Haynes et al. | |
| 6,703,086 | B2 | 3/2004 | Kronzer et al. | |
| 6,709,996 | B2 | 3/2004 | Mleziva et al. | |
| 6,716,511 | B2 | 4/2004 | Bersted et al. | |
| 6,740,385 | B2 | 5/2004 | Gardner et al. | |
| 6,756,327 | B2 | 6/2004 | Martin | |
| 6,783,834 | B2 | 8/2004 | Shepard et al. | |
| 6,849,142 | B1 | 2/2005 | Goulait | |
| 6,869,659 | B2 | 3/2005 | Shepard et al. | |
| 6,893,525 | B1 * | 5/2005 | Schmidt et al. | 156/209 |
| 6,948,221 | B2 | 9/2005 | Fuchs | |
| 6,955,847 | B1 | 10/2005 | Itou et al. | |
| 7,117,571 | B2 | 10/2006 | Dilo | |
| 7,156,937 | B2 | 1/2007 | Provost et al. | |
| 7,276,642 | B2 | 10/2007 | Belau | |
| 7,282,251 | B2 | 10/2007 | Provost et al. | |
| 2001/0051253 | A1 | 12/2001 | Tai et al. | |
| 2003/0077430 | A1 | 4/2003 | Grimm et al. | 428/198 |
| 2003/0119404 | A1 | 6/2003 | Belau et al. | |
| 2004/0020579 | A1 | 2/2004 | Durrance et al. | |
| 2004/0072491 | A1 | 4/2004 | Gillette et al. | |
| 2004/0131820 | A1 | 7/2004 | Turner | |
| 2004/0157036 | A1 | 8/2004 | Provost et al. | |
| 2004/0163221 | A1 | 8/2004 | Shepard et al. | |
| 2004/0229008 | A1 | 11/2004 | Hoying | |
| 2005/0196580 | A1 | 9/2005 | Provost et al. | |
| 2005/0196581 | A1 * | 9/2005 | Provost et al. | 428/85 |
| 2005/0196583 | A1 | 9/2005 | Provost et al. | |
| 2005/0208259 | A1 * | 9/2005 | Provost et al. | 428/88 |
| 2005/0217092 | A1 | 10/2005 | Barker et al. | |
| 2005/0281976 | A1 | 12/2005 | Curro et al. | |
| 2006/0105664 | A1 | 5/2006 | Zafiroglu | |
| 2006/0183389 | A1 | 8/2006 | Zafiroglu | |
| 2006/0225258 | A1 | 10/2006 | Barker et al. | |
| 2007/0178273 | A1 | 8/2007 | Provost et al. | |
| 2008/0113152 | A1 | 5/2008 | Provost et al. | |
| 2008/0305291 | A1 | 12/2008 | Nakaoka et al. | |

FOREIGN PATENT DOCUMENTS

| | | | | |
|---|---|---|---|---|
| EP | 0 211 564 | | 2/1992 | |
| EP | 0 482 749 | A1 | 4/1992 | |
| EP | 0 325 473 | | 3/1993 | |
| EP | 0 604 731 | A1 | 7/1994 | |
| EP | 0 765 616 | A1 | 4/1997 | |
| EP | 0 780 505 | A2 | 6/1997 | |
| EP | 0 598 085 | | 7/1997 | |
| EP | 0 597 075 | | 4/1998 | |
| EP | 0 882 828 | | 12/1998 | |
| EP | 0 937 420 | | 8/1999 | |
| EP | 0 726 977 | | 6/2000 | |
| EP | 0 862 868 | B1 | 6/2001 | |
| EP | 1 132 511 | | 9/2001 | |
| EP | 0 861 137 | | 1/2002 | |
| EP | 1 279 348 | | 1/2003 | |
| EP | 1279348 | A1 * | 1/2003 | A44B 18/00 |
| EP | 1 156 767 | | 10/2004 | |
| EP | 1 113 099 | | 3/2006 | |
| GB | 1228431 | | 4/1971 | |
| GB | 2 285 093 | | 6/1995 | |
| JP | 6-33359 | | 2/1994 | |
| JP | 06-123061 | | 5/1994 | |
| JP | 7-171011 | | 7/1995 | |
| JP | 08-27657 | | 1/1996 | |
| JP | 09 003755 | | 1/1997 | |
| JP | 09-195154 | | 7/1997 | |
| JP | 09-195155 | | 7/1997 | |
| JP | 09-241961 | | 9/1997 | |
| JP | 10-146207 | | 6/1998 | |
| JP | 10-151005 | | 6/1998 | |
| JP | 2971332 | | 11/1999 | |
| JP | 2000-314065 | | 11/2000 | |
| JP | 2001-212 | | 1/2001 | |
| JP | 2001-8713 | | 1/2001 | |
| JP | 3134709 | | 2/2001 | |
| JP | 2001-207369 | | 8/2001 | |
| JP | 2001-514346 | | 9/2001 | |
| JP | 2002-10807 | | 1/2002 | |
| JP | 2003-265207 | | 9/2003 | |
| JP | 2004-194730 | | 7/2004 | |
| JP | 3855084 | | 12/2006 | |
| JP | 3877842 | | 2/2007 | |
| WO | WO 92/01401 | | 2/1992 | |
| WO | WO 95/17111 | | 6/1995 | |
| WO | WO98/33410 | | 8/1998 | |
| WO | WO 99/11452 | | 3/1999 | |
| WO | WO 00/40793 | | 7/2000 | |
| WO | WO 00/42964 | | 7/2000 | |
| WO | WO01/80680 | | 1/2001 | |
| WO | WO 02/100207 | | 12/2002 | |
| WO | WO03/051251 | | 6/2003 | |
| WO | WO2004/019305 | | 3/2004 | |
| WO | WO2004/049853 | | 6/2004 | |
| WO | WO 2004/049853 | | 6/2004 | |
| WO | WO2004/058118 | | 7/2004 | |
| WO | WO2004/058497 | | 7/2004 | |
| WO | WO2004/059061 | | 7/2004 | |
| WO | WO2004/059117 | | 7/2004 | |
| WO | WO 2006/110575 | | 10/2006 | |
| WO | WO 2006/110598 | | 10/2006 | |

OTHER PUBLICATIONS

Narejo, D., et al, "Advances in Needlepunching", GFR, Jun./Jul. 2002, pp. 18-21.

PCT International Search Report and Written Opinion from PCT/US2006/013180 dated Aug. 25, 2006.

"Drawing" Definition, Complete Textile Glossary. Celanese Acetate. 2001. p. 49.

PCT International Search Report and Written Opinion from PCT/US2008/065938 dated Nov. 11, 2008.

U.S. Appl. No. 12/133,769, filed Jun. 5, 2008, Barker et al.

U.S. Appl. No. 12/133,945, filed Jun. 5, 2008, Provost et al.

Dilo Group, "Market Leadership in Nonwovens Technology", Pakistan Textile Journal, date: unknown (2 pages).

Dilo, "Engineering Excellence in Needle Looms!", Hyperpunch—The Solution for Fine and Quality Fleeces, Synthetic Leather, Spunbondeds, Papermachine Felts!, date unknown (2 pages).

Purdy Terry, Dilo Inc., Needle Punching Benefits from Elliptical Needle Paths, date unknown (13 pages).

PCT International Search Report and Written Opinion from PCT/US2008/065944, dated Nov. 25, 2008.

* cited by examiner

NEEDLING LOOPS INTO CARRIER SHEETS

RELATED APPLICATIONS

This application is a continuation-in-part application of, and claims priority under 35 U.S.C. §120 to, U.S. application Ser. No. 11/102,455, filed on Apr. 8, 2005, now abandoned which is a continuation-in-part application of, and claims priority under 35 U.S.C. §120 to, U.S. application Ser. No. 10/728,138, filed on Dec. 3, 2003, which claims priority under 35 U.S.C. §119(e)(1) to U.S. Provisional Application Ser. No. 60/430,731, filed on Dec. 3, 2002. This application also claims priority under 35 U.S.C. §119(e)(1) to U.S. Provisional Application Ser. No. 60/942,613, filed on Jun. 7, 2007, which is incorporated herein by reference.

TECHNICAL FIELD

This invention relates to methods of making sheet-form loop products, particularly by needling fibers into carrier sheets to form loops, and products produced thereby.

BACKGROUND

Touch fasteners are particularly desirable as fastening systems for lightweight, disposable garments, such as diapers. In an effort to provide a cost-effective loop material, some have recommended various alternatives to weaving or knitting, such as by needling a lightweight layer of fibers to form a light non-woven material that can then be stretched to achieve even lighter basis weight and cost efficiency, with the loop structures anchored by various binding methods, and subsequently adhered to a substrate. U.S. Pat. No. 6,329,016 teaches one such method, for example.

Materials with lower unit costs and better performance are desired. Reducing fiber content can lower cost, but can also affect overall performance or load-carrying capacity of the loop material, as well as the dimensional stability and handling efficiency of the loop product. Also, choice of fiber material is often compromised by a need for the loop material to be weld-compatible with a substrate (e.g., an outer layer of a diaper) to which the loop material is to be permanently bonded.

Various methods of bonding fibers to underlying substrates have also been taught, for forming touch fasteners and other loop-bearing materials.

SUMMARY

In one aspect, the invention features a method of making a sheet-form loop product, the method including placing a layer of staple fibers against a first side of a substrate, the substrate comprising a nonwoven web; needling fibers of the layer through the substrate by penetrating the substrate with needles that drag portions of the fibers through the substrate during needling, leaving exposed loops of the fibers extending from a second side of the substrate; and anchoring fibers forming the loops by fusing the fibers to each other and to filaments of the nonwoven web on the first side of the substrate, while substantially preventing fusion of the fibers on the second side of the substrate.

Some implementations may include one or more of the following features. The method may include, prior to fusing, heating the fibers from the first side of the substrate. The fibers may include bicomponent fibers having a core of one material and a sheath of another material, and anchoring the fibers may include melting material of the sheaths of the bicomponent fibers to bind fibers together. The step of anchoring the fibers to the substrate may include laminating the fibers to the substrate by a laminating process comprising passing the needled substrate through a nip defined between a compliant rubber roll and a hot can. The method may further include cooling the surface of the compliant rubber roll. The fibers may be loose and unconnected to the substrate until laminated. After anchoring, the fibers and filaments on the first side are fused together by a network of discrete bond points. Needling and anchoring forms loops sized and constructed to be releasably engageable by a field of hooks for hook-and-loop fastening. The nonwoven web has a relatively high filament density, and is formed of low denier filaments, e.g., the web may have a linear filament layer density of at least 25 filaments/layer, and may consist essentially of filaments having a denier of 6 or less. The nonwoven web may include filaments formed of a polymer selected from the group consisting of polyesters, polyamides, polyolefins, and blends and copolymer thereof. The filaments preferably have a relatively low specific gravity, e.g., a specific gravity of less than about 1.5 g/cm3 and preferably less than about 1.0 g/cm3. The nonwoven web is preferably lightweight. The staple fibers may be disposed on the substrate in a carded, unbonded state, in a layer of a total fiber weight of less than about 2 ounces per square yard (67 grams per square meter), e.g., no more than about one ounce per square yard (34 grams per square meter). The loop product may have an overall weight of less than about 5 ounces per square yard (167 grams per square meter).

In another aspect, the invention features a sheet-form loop product including a flexible nonwoven substrate, and a layer of staple fibers disposed on a first side of the substrate, exposed loops of the fibers extending from a second side of the substrate, with bases of the loops being anchored on the first side of the substrate. The fibers on the first side of the substrate are fused together to a relatively greater extent than the fibers on the second side of the substrate.

Some implementations may include one or more of the following features. The fibers are fused on the first side of the substrate in a network of discrete bond points. The fibers on the first side are fused directly to one another and to filaments of the nonwoven web. The fibers are substantially unbonded on the second side of the web, or, alternatively, the second side of the web includes embossed areas, and the fibers are bonded only in the embossed areas. The fibers may include bicomponent fibers having a core of one material and a sheath of another material, the fibers fused by melted material of the sheaths of the bicomponent fibers, and/or the fibers may include first fibers having a relatively high melting temperature and second fibers having a relatively lower melting temperature, the melting temperature of the second fibers being selected to allow the second fibers to fuse and anchor the loops. The bicomponent fibers or second fibers may make up between about 15 and 30 percent of the fibers, by weight. The loop product may also include any of the features discussed above with regard to the method.

The details of one or more embodiments of the invention are set forth in the accompanying drawings and the description below. Other features and advantages of the invention will be apparent from the description and drawings, and from the claims.

DESCRIPTION OF DRAWINGS

Like reference numerals in different figures designate similar features.

DETAILED DESCRIPTION

Descriptions of loop products will follow a description of some methods of making loop products.

Figure 1:
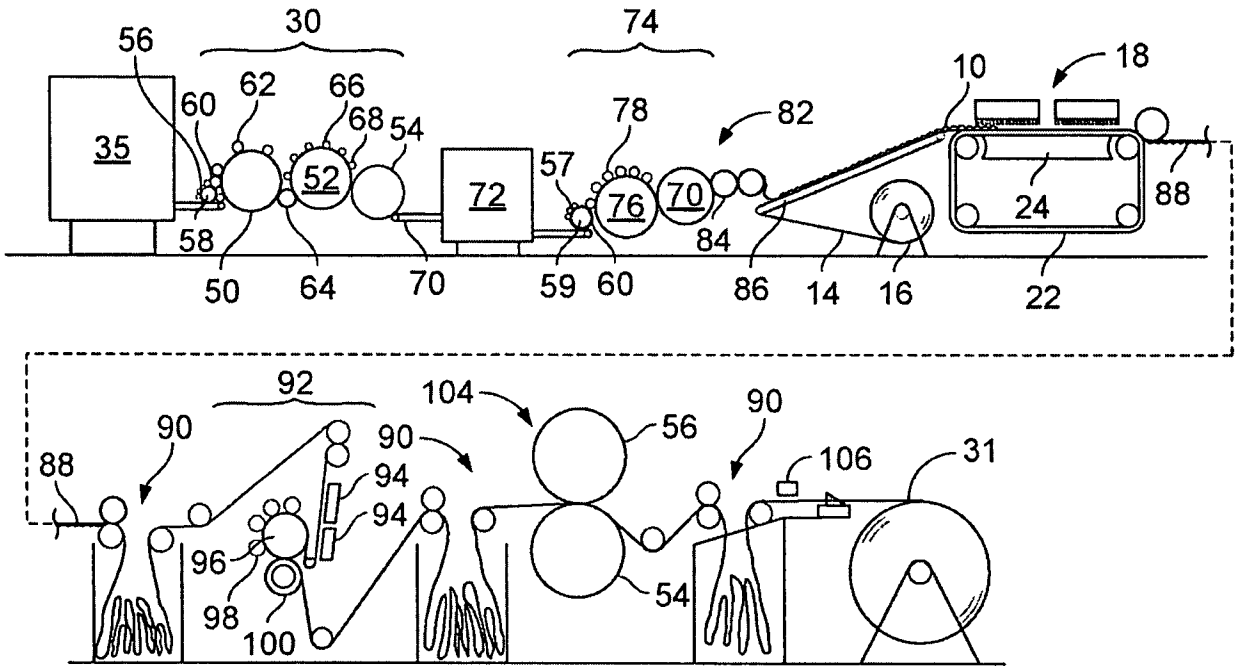
FIG. 1 is a diagrammatic view of a process for forming loop material.

FIG. 1 illustrates a machine and process for producing an inexpensive touch fastener loop product 31. Beginning at the upper left end of FIG. 1, a carded and cross-lapped layer of fibers 10 is created by two carding stages with intermediate cross-lapping. Weighed portions of staple fibers of different types are fed to the first carding station 30 by a card feeder 35. Card station 30 includes a 36-inch breast roll 50, a 60-inch breaker main 52, and a 50-inch breaker doffer 54. The first card feedroll drive includes 3-inch feedrolls 57 and a 3-inch cleaning roll on a 13-inch lickerin roll 59. 8-inch angle stripper 60 transfers the fiber to breast roll 50. There are three 8-inch worker roll sets 62 on the breast roll, and a 16-inch breast duffer 64 feeds breaker main 52, against which seven 8-inch worker sets 66 and a flycatcher 68 run. The carded fibers are combed onto a conveyer 70 that transfers the single fiber layer into a cross-lapper 72. Before cross-lapping, the carded fibers still appear in bands or streaks of single fiber types, corresponding to the fibrous balls fed to carding station 30 from the different feed bins. Cross-lapping, which normally involves a 90-degree reorientation of line direction, overlaps the fiber layer upon itself and is adjustable to establish the width of fiber layer fed into the second carding station 74. In this example, the cross-lapper output width is set to approximately equal the width of the carrier into which the fibers will be needled. Cross-lapper 72 may have a lapper apron that traverses a floor apron in a reciprocating motion. The cross-lappet lays carded webs of, for example, about 80 inches (1.5 meters) width and about one-half inch (1.3 centimeters) thickness on the floor apron, to build up several layers of criss-crossed web to form a layer of, for instance, about 80 inches (2.0 meters) in width and about 4 inches (10 centimeters) in thickness, comprising four double layers of carded web. During carding, the fibers are separated and combed into a cloth-like mat consisting primarily of parallel fibers. With nearly all of its fibers extending in the carding direction, the mat has some strength when pulled in the carding direction but almost no strength when pulled in the carding cross direction, as cross direction strength results only from a few entanglements between fibers. During cross-lapping, the carded fiber mat is laid in an overlapping zigzag pattern, creating a mat 10 of multiple layers of alternating diagonal fibers. The diagonal layers, which extend in the carding cross direction, extend more across the apron than they extend along its length.

Cross-lapping the web before the second carding process provides several tangible benefits. For example, it enhances the blending of the fiber composition during the second carding stage. It also allows for relatively easy adjustment of web width and basis weight, simply by changing cross-lapping parameters.

Second carding station 74 takes the cross-lapped mat of fibers and cards them a second time. The feedroll drive consists of two 3-inch feed rolls and a 3-inch cleaning roll on a 13-inch lickerin 58, feeding a 60-inch main roll 76 through an 8-inch angle stripper 60. The fibers are worked by six 8-inch worker rolls 78, the last five of which are paired with 3-inch strippers. A 50-inch finisher doffer 80 transfers the carded web to a condenser 82 having two 8-inch condenser rolls 84, from which the web is combed onto a carrier sheet 14 fed from spool 16. The condenser increases the basis weight of the web from about 0.7 osy (ounce per square yard) to about 1.0 osy, and reduces the orientation of the fibers to remove directionality in the strength or other properties of the finished product.

The carrier sheet 14, i.e., a nonwoven material such as a spunbond web, may be supplied as a single continuous length, or as multiple, parallel strips. Suitable nonwoven materials will be discussed in detail below. For particularly wide webs, it may be necessary or cost effective to introduce two or more parallel sheets, either adjacent or slightly overlapping. The parallel sheets may be unconnected or joined along a mutual edge. The carded, uniformly blended layer of fibers from condenser 82 is carried up conveyor 86 on carrier sheet 14 and into needling station 18. As the fiber layer enters the needling station, it has no stability other than what may have been imparted by carding and cross-lapping. In other words, the fibers are not pre-needled or felted prior to needling into the carrier sheet. In this state, the fiber layer is not suitable for spooling or accumulating prior to entering the needling station.

In needling station 18, the carrier sheet 14 and fiber are needle-punched from the fiber side. The needles are guided through a stripping plate above the fibers, and draw fibers through the carrier sheet 14 to form loops on the opposite side. During needling, the carrier sheet is supported on a bed of bristles extending from a driven support belt or brush apron 22 that moves with the carrier sheet through the needling station. Alternatively, carrier sheet 14 can be supported on a screen or by a standard stitching plate (not shown). Reaction pressure during needling is provided by a stationary reaction plate 24 underlying apron 22. In this example, needling station 18 needles the fiber-covered carrier sheet 14 with an overall penetration density of about 80 to 160 punches per square centimeter. During needling, the thickness of the carded fiber layer only decreases by about half, as compared with felting processes in which the fiber layer thickness decreases by one or more orders of magnitude. As fiber basis weight decreases, needling density may need to be increased.

The needling station 18 may be a "structuring loom" configured to subject the fibers and carrier web to a random velouring process. Thus, the needles penetrate a moving bed of bristles arranged in an array (brush apron 22). The brush apron may have a bristle density of about 2000 to 3000 bristles per square inch (310 to 465 bristles per square centimeter), e.g., about 2570 bristles per square inch (400 per square centimeter). The bristles are each about 0.018 inch (0.46 millimeter) in diameter and about 20 millimeters long, and are preferably straight. The bristles may be formed of any suitable material, for example 6/12 nylon. Suitable brushes may be purchased from Stratosphere, Inc., a division of Howard Brush Co., and retrofitted onto DILO and other random velouring looms. Generally, the brush apron moves at the desired line speed.

Alternatively, other types of structuring looms may be used, for example those in which the needles penetrate into a plurality of lamella or lamellar disks.

FIGS. 2A through 2D sequentially illustrate the formation of a loop structure by needling. As a forked needle enters the fiber mat 10 (FIG. 2A), some individual fibers 12 will be captured in the cavity 36 in the forked end of the needle. As needle 34 pierces carrier sheet 14 (FIG. 2B), these captured fibers 12 are drawn with the needle through the hole 38 formed in the carrier sheet to the other side of the carrier sheet. As shown, carrier sheet 14 remains generally supported by bristles 20 through this process, the penetrating needle 34 entering a space between adjacent bristles. Alternatively, carrier sheet 14 can be supported by a screen or stitching plate (not shown) that defines holes aligned with the needles. As needle 34 continues to penetrate (FIG. 2C), tension is applied to the captured fibers, drawing mat 10 down against carrier sheet 14. In this example, a total penetration depth "$D_p$" of about 5.0 millimeters, as measured from the entry surface of carrier sheet 14, was found to provide a well-formed loop structure without overly stretching fibers in the remaining mat. Excessive penetration depth can draw loop-forming fibers from earlier-formed tufts, resulting in a less robust loop field. Penetration depths of 2 to 8 millimeters also worked in this example, with 6 mm and 8 mm penetration being presently preferred. When needle 34 is retracted (FIG. 2D), the portions of the captured fibers 12 carried to the opposite side of the carrier web remain in the form of a plurality of individual loops 40 extending from a common trunk 43 trapped in hole 38. The final loop formation preferably has an overall height "$H_L$" Of about 0.040 to 0.090 inch (1.0 to 2.3 millimeters), for engagement with the size of male fastener elements commonly employed on disposable garments and such.

Advance per stroke is limited due to a number of constraints, including needle deflection and potential needle breakage. Thus, it may be difficult to accommodate increases in line speed and obtain an economical throughput by adjusting the advance per stroke. As a result, the holes pierced by the needles may become elongated, due to the travel of the carrier sheet while the needle is interacting with the carrier sheet (the "dwell time"). This elongation is generally undesirable, as it reduces the amount of support provided to the base of each of the loop structures by the surrounding substrate, and may adversely affect resistance to loop pull-out. Moreover, this elongation will tend to reduce the mechanical integrity of the carrier sheet due to excessive drafting, i.e., stretching of the carrier sheet in the machine direction and corresponding shrinkage in the cross-machine direction.

Figure 2A:
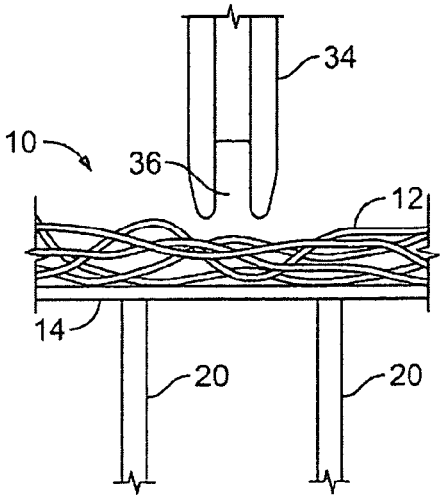
FIGS. 2A-2D are diagrammatic side views of stages of a needing step of the process of FIG. 1.
Figure 2B:
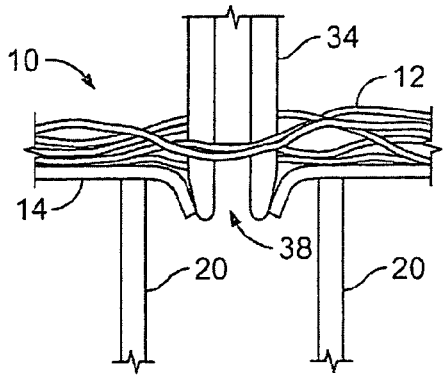
Figure 2C:
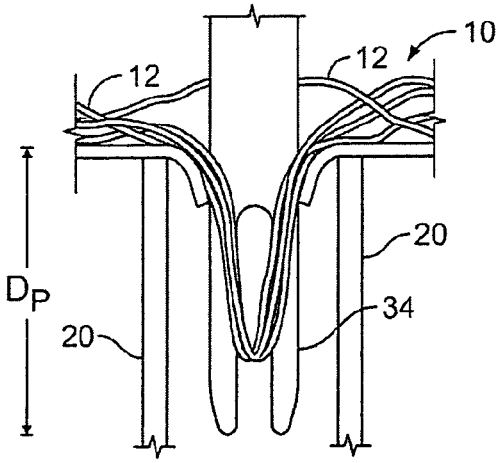
Figure 2D:
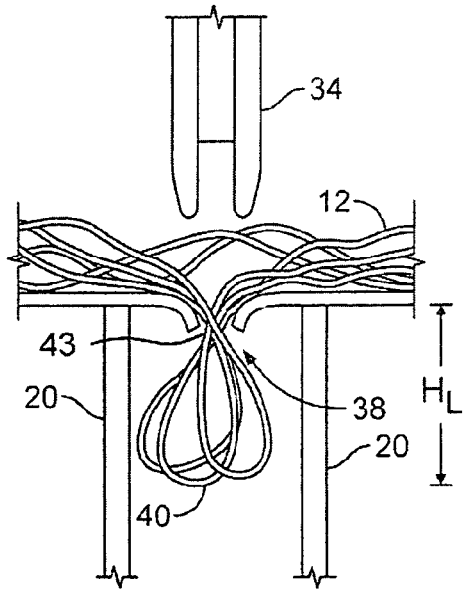
Figure 2E:
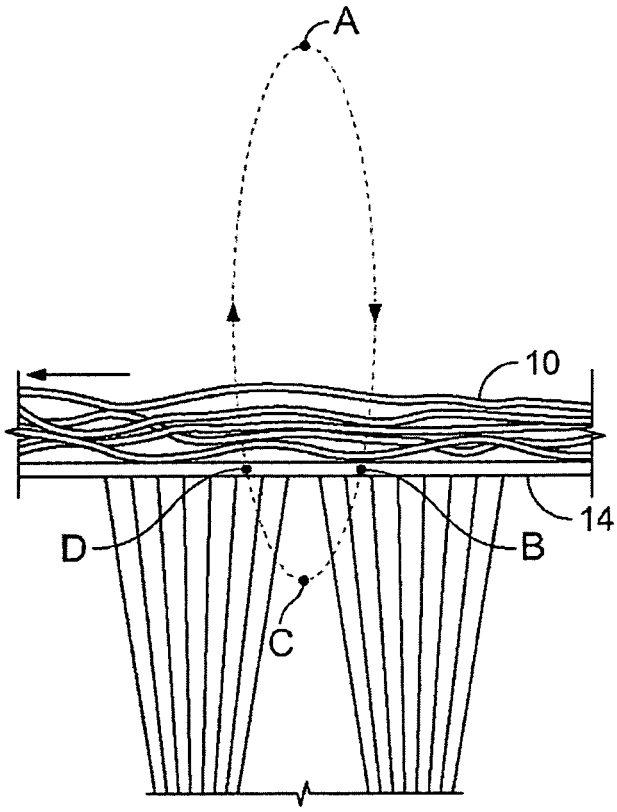
FIG. 2E is a diagrammatic side view showing an elliptical path that may be followed by the needle during needling.

Elongation of the holes may be reduced or eliminated by causing the needles to travel in a generally elliptical path, viewed from the side. This elliptical path is shown schematically in FIG. 2E. Referring to FIG. 2E, each needle begins at a top "dead" position A, travels downward to pierce the carrier sheet (position B) and, while it remains in the carrier sheet (from position B through bottom "dead" position C to position D), moves forward in the machine direction. When the needle has traveled upward sufficiently for its tip to have exited the pierced opening (position D), it continues to travel upward, free of the carrier sheet, while also returning horizontally (opposite to the machine direction) to its normal, rest position (position A), completing the elliptical path. This elliptical path of the needles is accomplished by moving the entire needle board simultaneously in both the horizontal and vertical directions. Needling in this manner is referred to herein as "elliptical needling." Needling looms that perform this function are available from DILO System Group, Eberbach, Germany, under the tradename "HYPERPUNCH Systems."

During elliptical needling, the horizontal travel of the needle board is preferably roughly equivalent to the distance that the carrier sheet advances during the dwell time. The horizontal travel is a function of needle penetration depth, vertical stroke length, carrier sheet thickness, and advance per stroke. Generally, at a given value of needle penetration and carrier sheet thickness, horizontal stroke increases with increasing advance per stroke. At a fixed advance per stroke, the horizontal stroke generally increases as depth of penetration and web thickness increases.

For example, for a carrier sheet having a thickness of 0.0005 inch (so thin that it is not taken into account), a loom outfeed of 18.9 m/min, an effective needle density of 15,006 needles/meter, a vertical stroke of 35 mm, a needle penetration of 5.0 mm, and a headspeed of 2,010 strokes/min, the preferred horizontal throw (i.e., the distance between points B and D in FIG. 2E) would be 3.3 mm, resulting in an advance per stroke of 9.4 mm.

Using elliptical needling, it may be possible to obtain line speeds 30 ypm (yards/minute) or mpm (meters/minute) or greater, e.g., 50 ypm or mpm, for example 60 ypm. Such speeds may be obtained with minimal elongation of the holes, for example the length of the holes in the machine direction may be less than 20% greater than the width of the holes in the cross-machine direction, preferably less than 10% greater and in some instances less than 5% greater.

For needling longitudinally discontinuous regions of the material, such as to create discrete loop regions as discussed further below, the needle boards can be populated with needles only in discrete regions, and the needling action paused while the material is indexed through the loom between adjacent loop regions. Effective pausing of the needling action can be accomplished by altering the penetration depth of the needles during needling, including to needling depths at which the needles do not penetrate the carrier sheet. Such needle looms are available from FEHRER AG in Austria, for example. Alternatively, means can be implemented to selectively activate smaller banks of needles within the loom according to a control sequence that causes the banks to be activated only when and where loop structures are desired. Lanes of loops can be formed by a needle loom with lanes of needles separated by wide, needle-free lanes.

In the example illustrated, the needled product 88 leaves needling station 18 and brush apron 22 in an unbonded state, and proceeds to a lamination station 92. Prior to the lamination station, the web passes over a gamma gage (not shown) that provides a rough measure of the mass per unit area of the web. This measurement can be used as feedback to control the upstream carding and cross-lapping operations. The web is stable enough at this stage to be accumulated in an accumulator 90 between the needling and lamination stations. As known in the art, accumulator 90 is followed by a spreading roll (not shown) that spreads and centers the web prior to entering the next process. Prior to lamination, the web may also pass through a coating station (not shown) in which a binder is applied to enhance lamination. In lamination station 92, the web first passes by one or more infrared heaters 94 that preheat the fibers and/or carrier sheet from the side opposite the loops. In products relying on bicomponent fibers for bonding, heaters 94 preheat and soften the sheaths of the bicomponent fibers. In one example, the heater length and line speed are such that the web spends about four seconds in front of the heaters. Just prior to the heaters are two scroll rolls 93. The scroll rolls each have a herringbone helical pattern on their surfaces and rotate in a direction opposite to the direction of travel of the web, and are typically driven with a surface speed that is four to five times that of the surface speed of the web. The scroll rolls put a small amount of drag on the material, and help to dewrinkle the web. Just downstream of the heaters is a web temperature sensor (not shown) that provides feedback to the heater control to maintain a desired web exit temperature.

Figure 3:
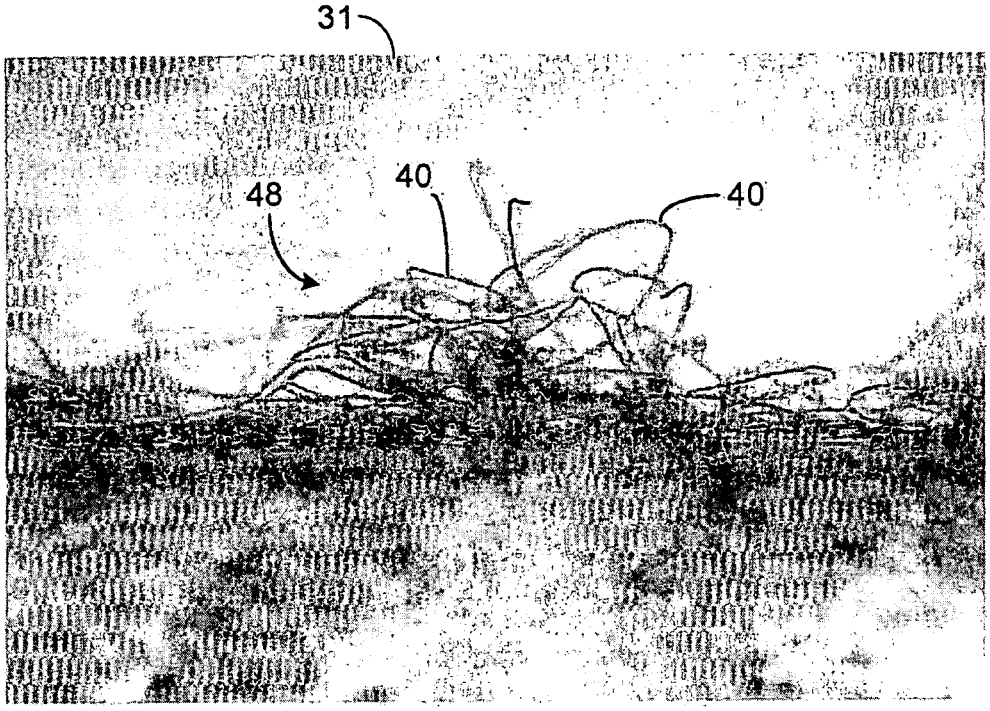
FIG. 3 is a photograph of the front (loop) surface of the needled loop material at a magnification of 32×, showing a loop structure formed by needling staple fibers from the back surface of the material.

FIG. 3 shows a loop structure 48 containing multiple loops 40 extending through a common hole in the carrier sheet, as formed by the above-described needling. As shown, loops 40 stand proud of the underlying carrier sheet, available for engagement with a mating hook product, due at least in part to the anchoring of the fibers to each other and the carrier sheet. This vertical stiffness acts to resist permanent crushing or flattening of the loop structures, which can occur when the loop material is spooled or when the finished product to which the loop material is later joined is compressed for packaging. Resiliency of the loops 40, especially at their juncture with the carrier sheet, enables structures 48 that have been "toppled" by heavy crush loads to right themselves when the load is removed. The various loops 40 of formation 48 extend to different heights from the carrier sheet, which is also believed to promote fastener performance. Because each formation 48 is formed at a site of a penetration through the carrier sheet during needling, the density and location of the individual structures are very controllable. Preferably, there is sufficient distance between adjacent structures so as to enable good penetration of the field of formations by a field of mating male fastener elements (not shown). Each of the loops 40 is of a staple fiber whose ends are disposed on the opposite side of the carrier sheet, such that the loops are each structurally capable of hook engagement.

Figure 3A:
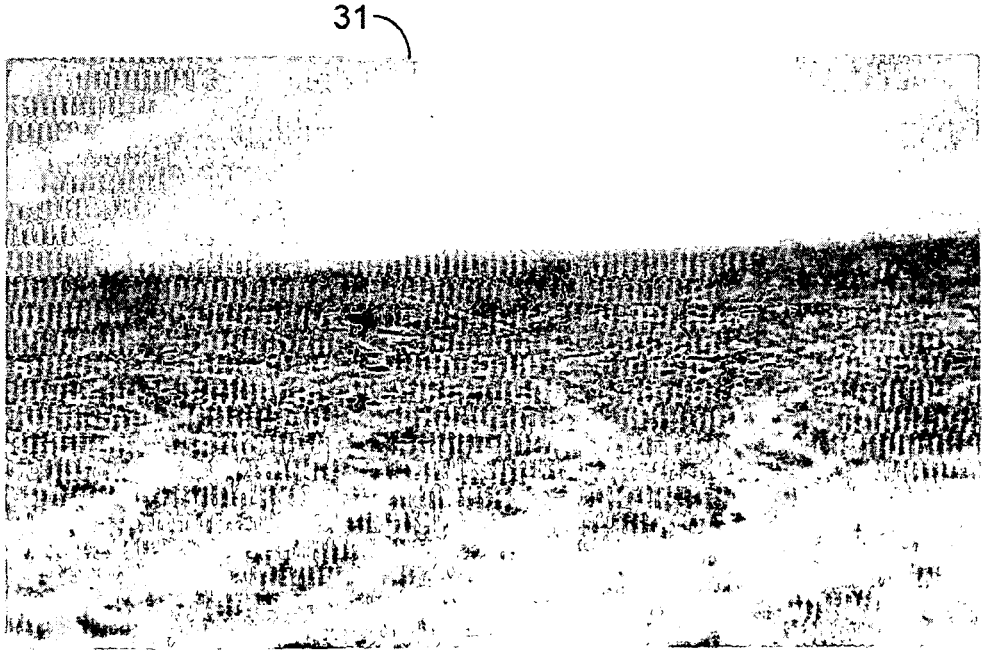
FIG. 3A is a photograph looking along the back surface of the loop material, at a magnification of 32×, showing an absence of loop structures.

By contrast, the back surface of the loop product is relatively flat, void of extending loop structures, as shown in FIG. 3A.

Because of the relatively low amount of fibers remaining in the mat, together with the thinness of the carrier sheet and any applied backing layer, the mat (i.e., the base portion of the loop material including the carrier sheet, not including the extending loop structures) can have a thickness of only about 0.008 inch (0.2 millimeters) or less, preferably less than about 0.005 inch, and even as low as about 0.001 inch (0.025 millimeter) in some cases. The carrier sheet 14 may have a thickness of less than about 0.002 inch (0.05 millimeter), preferably less than about 0.001 inch (0.025 millimeter) and even more preferably about 0.0005 inch (0.013 millimeter). The finished loop product 31 has an overall thickness of less than about 0.15 inch (3.7 millimeters), preferably less than about 0.1 inch (2.5 millimeters), and in some cases less than about 0.05 inch (1.3 millimeter). The overall weight of the loop fastener product, including carrier sheet, fibers and fused binder (an optional component, discussed below), is preferably less than about 5 ounces per square yard (167 grams per square meter). For some applications, the overall weight is less than about 2 ounces per square yard (67 grams per square meter), or in one example, about 1.35 ounces per square yard (46 grams per square meter).

In the example shown in the photographs, the mat thickness was determined by determining the locations of the front and rear faces of the mat by focal depth on an optical table, and was so measured to be about 0.006 inch (0.15 millimeter). Similarly, the loft of the loop structures, measured from the front face of the mat to the top of the loop structures, was about 0.020 inch (0.5 millimeter) uncompressed (i.e., the uncompressed loft was between 3 and 4 times the mat thickness), and was about 0.008 inch (0.2 millimeter) compressed under a 6 millimeter thick sheet of glass.

Referring back to FIG. 1, the heated, needled web is trained about a 20 inch (50 centimeter) diameter hot can 96 against which four idler rolls 98 of five inch (13 centimeters) solid diameter, and a driven, rubber roll 100 of 18 inch (46 centimeter) diameter, rotate under controlled pressure. Idler rolls 98 are optional and may be omitted if desired. Alternatively, light tension in the needled web can supply a light and consistent pressure between the web and the hot can surface prior to the nip with rubber roll 100, to help to soften the bonding fiber surfaces prior to lamination pressure. The rubber roll 100 presses the web against the surface of hot can 96 uniformly over a relatively long 'kiss' or contact area, bonding the fibers over substantially the entire back side of the web.

The rubber roll 100 is cooled, as will be discussed in detail below, to prevent overheating and crushing or fusing of the loop fibers on the front surface of the web, thereby allowing the loop fibers to remain exposed and open for engagement by hooks. Protecting the loop structures from excessive heat during lamination significantly improves the performance of the material as a touch fastener, as the loop structures remain extended from the base for hook engagement. For many materials, the bonding pressure between the rubber roll and the hot can is quite low, in the range of about 1-50 pounds per square inch (70-3500 grams per square centimeter) or less, e.g., about 15-40 psi (1050 to 2800 grams per square centimeter), and in one example about 25 psi (1750 gsm). The surface of hot can 96 is maintained at a temperature of about 306 degrees Fahrenheit (150 degrees Celsius) for one example employing bicomponent polyester fiber and polyester spunbond carrier sheet running at a line speed of 20.1 meters per minute, to avoid melting the polyester carrier and the bicomponent cores. In this example the web is trained about an angle of around 300 degrees about hot can 96, resulting in a dwell time against the hot can of about four seconds. The hot can 96 can have a compliant outer surface, or be in the form of a belt. As an alternative to roller nips, a flatbed fabric laminator (not shown) can be employed to apply a controlled lamination pressure for a considerable dwell time. Such flatbed laminators are available from Glenro Inc. in Paterson, N.J. In some applications, the finished loop product is passed through a cooler (not shown) prior to embossing.

Figure 4:
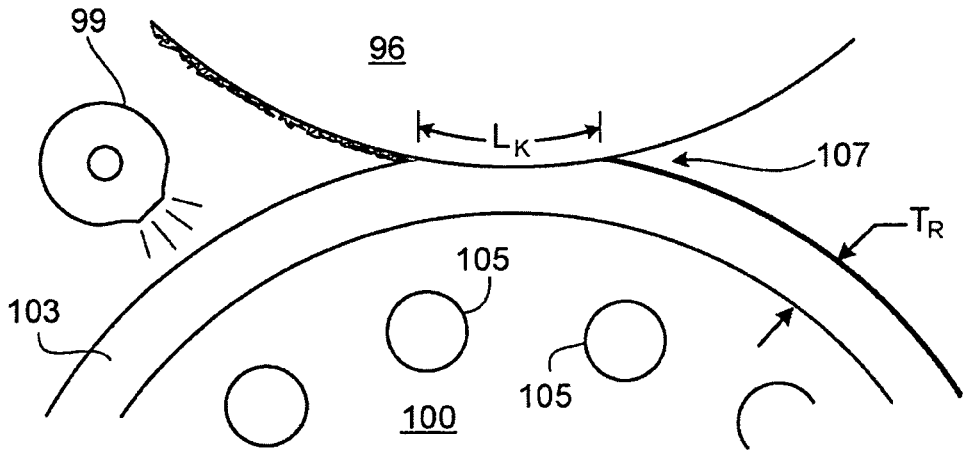
FIG. 4 is an enlarged diagrammatic view of the lamination nip through which the loop material passes during the process of FIG. 1.

FIG. 4 is an enlarged view of the nip 107 between hot can 96 and the rubber roll 100. As discussed above, due to the compliant nature of the rubber roll, uniform pressure and heat is applied to the entire back surface of the web, over a relatively large contact area. The hot can contacts the fibers on the back side of the web to fuse the fibers to each other and/or to fibers of the non-woven carrier sheet, forming a network 42 of fused fibers extending over the entire back surface of the carrier sheet. The rubber surface layer 103 of roll 100 has a radial thickness $T_R$ of about 22 millimeters, and has a surface hardness of about 65 shore DO. Nip pressure is maintained between the rolls such that the nip kiss length $L_k$ about the circumference of hot can 96 in this example is about 25 millimeters, with a nip dwell time of about 75 milliseconds. Leaving the nip, the laminated web travels on the surface of cooled roll 100. Rubber roll 100 has a cooled steel core supporting the rubber surface layer. Liquid coolant is circulated through cooling channels 105 in the steel core to maintain a core temperature of about 55 degrees F. (12.7 degrees C.) while an air plenum 99 discharges multiple jets of air against the rubber roll surface to maintain a rubber surface temperature of about 140 degrees F. (60 degrees C.) entering nip 107.

Figure 5:
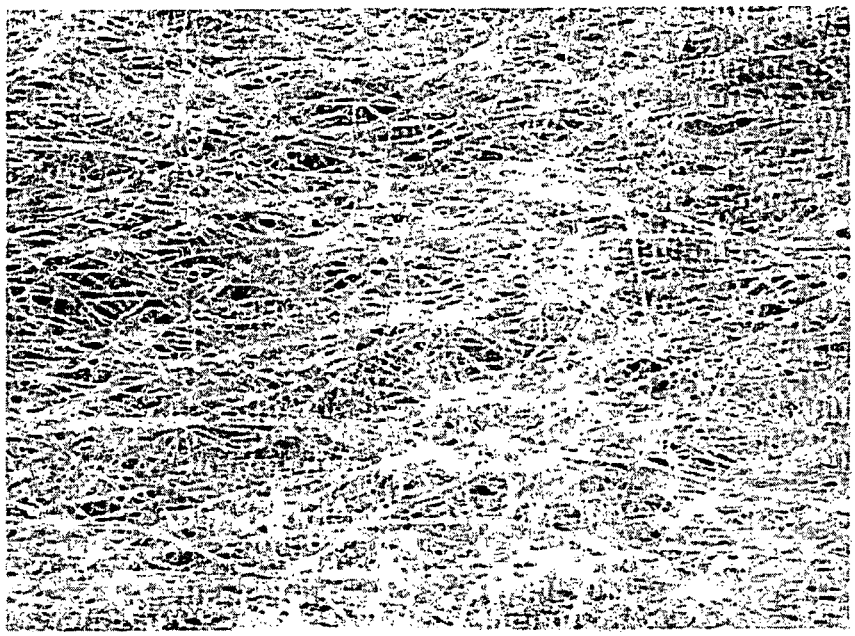
FIG. 5 is a photograph looking directly at the back surface of the loop material after lamination, at a magnification of 32×, showing the fibrous and bonded structure of the laminated surface.
Figure 5A:
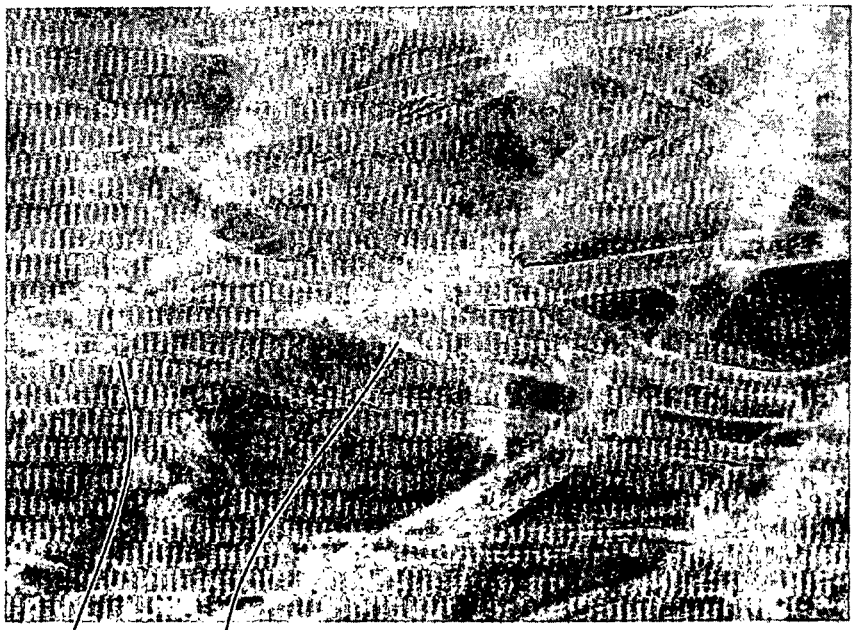
FIG. 5A is a photograph looking directly at the back surface of the loop material after lamination, at a magnification of 305×, showing individual bond points between fibers.

Referring to FIGS. 5 and 5A, the back surface of the loop material leaving the nip is fused and relatively flat. If bicomponent fibers are used, and the laminating parameters are selected so that only the lower melting portion of the bicomponent fibers melts during lamination, resulting in a network of discrete bond points 109 where individual bicomponent fibers at or near the back surface of the web cross other fibers, the sheaths of the bicomponent fibers acting as an adhesive to bond the fibers together, while the cores of the fibers remain substantially intact. The back surface thus retains a very fibrous appearance, with individual fibers maintaining their integrity. In the case of staple fibers that have been drawn to increase their fiber strength, the individual fibers tend to maintain their longitudinal molecular orientation through the bond points. The bond point network is therefore random and sufficiently dense to effectively anchor the fiber portions extending through the non-woven carrier sheet to the front side to form engageable loop formations. The bond point network is not so dense that the web becomes air-impermeable. The resulting loop product will have a soft hand and working flexibility for use in applications where textile properties are desired. In other applications it may be acceptable or desirable to fuse the fibers to form a solid mass on the back side of the web. In either case, the fused network of bond points creates a very strong, dimensionally stable web of fused fibers across the non-working side of the loop product that is still sufficiently flexible for many uses. When bicomponent fibers are used, the number of fused fiber intersections, where bicomponent fibers have partially melted, is such that staple fibers with portions extending through holes to form engageable loops have other portions, such as their ends, secured in one or more fused areas which anchor the loop fibers against pullout from hook loads.

Figure 5B:
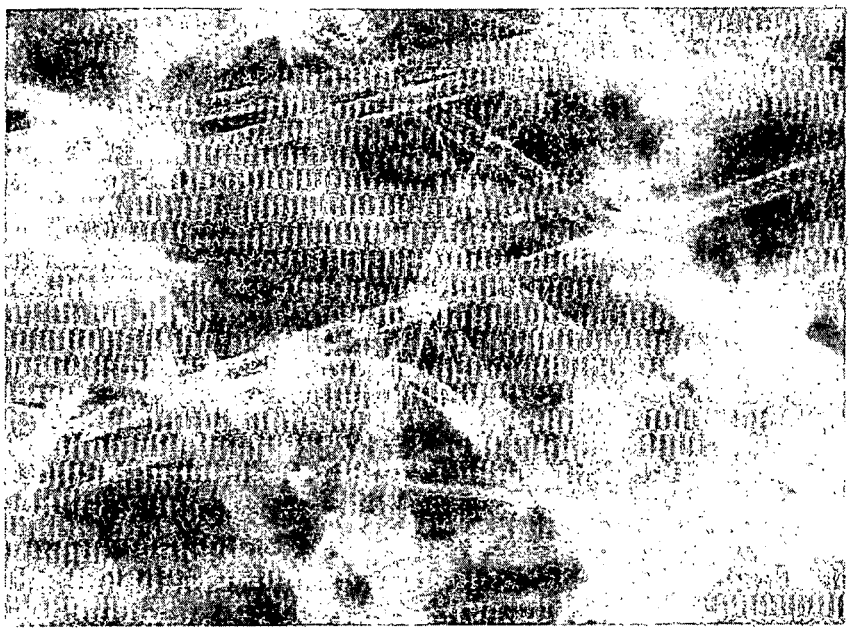
FIG. 5B is a photograph looking directly at the front surface of the loop material after lamination, at a magnification of 305× and focused on the front surface of the fibrous mat, showing a relative absence of bond points.

The bond point network is disposed primarily at or near the back side of the fused mat. The front surface of the mat remains substantially less bonded than the back surface, as illustrated in FIG. 5B. As shown, the bicomponent fiber sheaths at the front mat surface remain relatively intact, with few bonded crossings. The filaments of the nonwoven carrier sheet also retain their fibrous appearance.

If desired, a backing sheet (not shown) can be introduced between the hot can and the needled web, such that the backing sheet is laminated over the back surface of the loop product while the fibers are bonded under pressure in the nip.

Referring back to FIG. 1, from lamination station 92 the laminated web moves through another accumulator 90 to an embossing station 104, where a desired pattern of locally raised regions is embossed into the web between two counter-rotating embossing rolls. In some cases, the web may move directly from the laminator to the embossing station, without accumulation, so as to take advantage of any latent temperature increase caused by lamination. The loop side of the bonded loop product is embossed with a desired embossing pattern prior to spooling. In this example the loop product is passed through a nip between a driven embossing roll 54 and a backup roll 56. The embossing roll 54 has a pattern of raised areas that permanently crush the loop formations against the carrier sheet, and may even melt a proportion of the fibers in those areas. Embossing may be employed simply to enhance the texture or aesthetic appeal of the final product. Generally, the laminated web has sufficient strength and structural integrity so that embossing is not needed to (and typically does not) enhance the physical properties of the product.

In some cases, roll 56 has a pattern of raised areas that mesh with dimples in roll 54, such that embossing results in a pattern of raised hills or convex regions on the loop side, with corresponding concave regions on the non-working side of the product, such that the embossed product has a greater effective thickness than the pre-embossed product. More details of a suitable embossing pattern are discussed below with respect to FIG. 6.

The embossed web then moves through a third accumulator 90, past a metal detector 106 that checks for any broken needles or other metal debris, and then is slit and spooled for storage or shipment. During slitting, edges may be trimmed and removed, as can any undesired carrier sheet overlap region necessitated by using multiple parallel strips of carrier sheet.

We have found that, using the process described above, a useful loop product may be formed with relatively little fiber 12. In one example, mat 10 has a basis weight of only about 1.0 osy (33 grams per square meter). Fibers 12 are drawn and crimped polyester fibers, 3 to 6 denier, of about a four-inch (10 centimeters) staple length, mixed with crimped bicomponent polyester fibers of 4 denier and about two-inch (50 mm) staple length. The ratio of fibers may be, for example, 80 percent solid polyester fiber to 20 percent bicomponent fiber. In other embodiments, the fibers may include 15 to 30 percent bicomponent fibers. The preferred ratio will depend on the composition of the fibers and the processing conditions. Generally, too little bicomponent fiber may compromise loop anchoring, due to insufficient fusing of the fibers, while too much bicomponent fiber will tend to increase cost and may result in a stiff product and/or one in which some of the loops are adhered to each other. The bicomponent fibers are core/sheath drawn fibers consisting of a polyester core and a copolyester sheath having a softening temperature of about 110 degrees Celsius, and are employed to bind the solid polyester fibers to each other and the carrier.

In this example, both types of fibers are of round cross-section and are crimped at about 7.5 crimps per inch (3 crimps per centimeter). Suitable polyester fibers are available from INVISTA of Wichita, Kans., (www.invista.com) under the designation Type 291. Suitable bicomponent fibers are available from Consolidated Textiles under the designation Low Melt Bonding Fibers. As an alternative to round cross-section fibers, fibers of other cross-sections having angular surface aspects, e.g. fibers of pentagon or pentalobal cross-section, can enhance knot formation during needling.

In some cases, the fibers may not include bicomponent fibers. For example, the staple fibers may all be formed of a single polymer. If the polymer used to form the staple fibers is not sufficiently adherent to itself and/or to the filaments of the nonwoven carrier sheet, the staple fibers may be predominantly of a first polymer, such as polypropylene, with fibers of a second, more adherent binder, such as high density polyethylene (HDPE) used to provide bonding between fibers and to the filaments of the nonwoven.

Loop fibers with tenacity values of at least 2.8 grams per denier have been found to provide good closure performance, and fibers with a tenacity of at least 5 or more grams per denier (preferably even 8 or more grams per denier) are even more preferred in many instances. In general terms for a loop-limited closure, the higher the loop tenacity, the stronger the closure. The polyester fibers of mat 10 are in a drawn, molecular oriented state, having been drawn with a draw ratio of at least 2:1 (i.e., to at least twice their original length) under cooling conditions that enable molecular orientation to occur, to provide a fiber tenacity of about 4.8 grams per denier.

Loop strength is directly proportional to fiber strength, which is the product of tenacity and denier. Fibers having a fiber strength of at least 6 grams, for example at least 10 grams, provide sufficient loop strength for many applications. Where higher loop strength is required, the fiber strength may be higher, e.g., at least 15. Strengths in these ranges may be obtained by using fibers having a tenacity of about 2 to 7 grams/denier and a denier of about 1.5 to 5, e.g., 2 to 4. For example, a fiber having a tenacity of about 4 grams/denier and a denier of about 3 will have a fiber strength of about 12 grams.

The engagement strength of the loop product is also dependent on the density and uniformity of the loop structures over the surface area of the loop product. The density and uniformity of the loop structures is determined in part by the coverage of the fibers on the carrier sheet. In other words, the coverage will affect how many of the needle penetrations will result in hook-engageable loop structures. Fiber coverage is indicative of the length of fiber per unit area of the carrier sheet, and is calculated as follows:

Fiber coverage (meters per square meter)=(Basis Weight/Denier)×9000. Thus, in order to obtain a relatively high fiber coverage at a low basis weight, e.g., less than 2 osy, it is desirable to use relatively low denier (i.e., fine) fibers, for example having a denier of 3 or less. The use of low denier fibers allows good coverage to be obtained at a low basis weight, providing more fibers for engagement with male fastener elements. However, the use of low denier fibers may require that the fibers have a higher tenacity to obtain a given fiber strength, as discussed above. Higher tenacity fibers are generally more expensive than lower tenacity fibers. Moreover, for some applications higher denier fibers may be desirable to provide particular physical characteristics such as imparting crush resistance to the loops. Thus, the desired strength, cost and weight characteristics of the product must be balanced to determine the appropriate basis weight, fiber tenacity and denier for a particular application. It is generally preferred that the fiber layer of the loop product have a calculated fiber coverage of at least 50,000, preferably at least 90,000, and more preferably at least 100,000.

It is very important that fiber coverage be achieved without compromising the lightweight and low cost characteristics of the loop product. To produce loop materials having a good balance of low cost, light weight and good performance, it is generally preferred that the basis weight be less than 2.0 osy, e.g., 1.0 to 2.0 osy, and the coverage be about 50,000 to 200,000.

Various synthetic or natural fibers may be employed. In some applications, wool and cotton may provide sufficient fiber strength. Presently, thermoplastic staple fibers which have substantial tenacity are preferred for making thin, low-cost loop product that has good closure performance when paired with very small molded hooks. For example, polyolefins (e.g., polypropylene or polyethylene), polyesters, polyamides (e.g., nylon), acrylics and mixtures, alloys, copolymers and co-extrusions thereof are suitable. Polyester is presently preferred. Fibers having high tenacity and high melt temperature may be mixed with fibers of a lower melt temperature resin. For a product having some electrical conductivity, a small percentage of metal fibers may be added. For instance, loop products of up to about 5 to 10 percent fine metal fiber, for example, may be advantageously employed for grounding or other electrical applications.

Various nonwoven webs can be used as the carrier sheet. In one example, mat 10 is laid upon a spunbond web. Spunbond webs, and other suitable nonwoven webs, include continuous filaments that are entangled and fused together at their intersections, e.g., by hot calendaring in the case of spunbond webs. Some preferred webs are also point bonded. For example, the spunbond web may include a non-random pattern of fused areas, each fused area being surrounded by unfused areas. The fused areas may have any desired shape, e.g., diamonds or ovals, and are generally quite small, for example on the order of several millimeters. One preferred spunbond web is commercially available from Oxco, Inc., Charlotte, N.C. under the tradename POLYON A017P79WT1. This material is a point bonded 100% polyester spunbond having a basis weight of 17 gsm.

Suitable nonwoven webs have a sufficiently high filament density so that they support the loop structures after the fibers have been needled through the carrier. For example, preferred webs have a linear filament layer density of at least 40 filaments per layer in a 1 inch×1 inch×0.003 inch sample, and more preferably about 40 to 110 filaments per layer. To calculate linear filament layer density, we calculate the total length (in inches) of filament in a one inch by one inch square area, based on denier and basis weight, and then divide that total filament length by the number of filament thicknesses in the overall thickness of the web. The result would equate to the number of filaments in each layer of the square one inch area, if all filaments ran orthogonally and were distributed evenly in each layer, and is a reasonable quantification of filament density, for comparison between webs. In preferred webs, the filaments have a denier of from about 1 to 7, preferably about 3 to 6. In some implementations, the filaments have substantially the same denier as the staple fibers, e.g., within about 1 denier. The lower the denier, the higher the preferred linear filament layer density, in order to ensure a tight web with good coverage and thus good support for the loop structures. Furthermore, for heavier filament materials a higher basis weight is required to achieve a particular linear filament layer density. For example, for polyester with a specific gravity of 1.38 grams per cubic centimeter, a 1 denier spunbond web having a 0.5 osy basis weight and a 0.003 inch (0.075 millimeter) thickness would have a linear filament layer density of about 58 filaments/layer, while the same spunbond material made with a 0.91 grams per cubic centimeter polypropylene would have a linear filament layer density of about 108 filaments/layer. Generally we prefer to have a linear filament layer density of at least about 25 filaments/layer, and more preferably at least about 60 filaments/layer.

For many applications, it is important that the carrier sheet also be lightweight and inexpensive. It is thus generally desirable that the filament material have a relatively low specific gravity, so that a given length of filament will weigh as little as possible. Preferably, the specific gravity of the filament material is less than about 1.5, more preferably less than about 1.0 g/cm$^3$. In order to minimize weight, it is also generally preferred that the nonwoven web be thin, for example less than 0.005 inches thick, e.g., 0.003 inches thick or less. Some preferred nonwoven webs have a weight of less than 50 g/m$^2$ (less than 1.46 osy), e.g., about 12 to 17 g/m$^2$ (about 0.35 to 0.50 osy).

To optimize anchoring of the loops, it is desirable that the fibers fuse not only to themselves on the back side of the web, but also to the filaments of the nonwoven web (carrier sheet). To this end, it is generally desirable that the material of the filaments of the nonwoven web be chemically compatible with the surface material of the bicomponent fibers. In some cases the fibers, or the sheath material of the bicomponent fibers, may be of the same polymer as the filaments of the carrier sheet.

The carrier sheet can include other layers in addition to the nonwoven layer, though this may not be desirable if weight and cost are to be minimized. If desired, the carrier sheet may further include a film, e.g., a very thin polymer film having a thickness of about 0.002 inch (0.05 millimeter) or less. Suitable films include polyesters, polyamides, polypropylenes, EVA, and their copolymers. Other materials may be used to provide desired properties for particular applications. For example, fibers may be needle-punched into paper, scrim, or fabrics such as non-woven, woven or knit materials, for example lightweight cotton sheets. The additional layer may be positioned on either side of the nonwoven carrier sheet. If the needled fibers would not bond well to the additional layer, the additional layer would generally be positioned on the loop side of the nonwoven carrier.

A pre-printed nonwoven, e.g., a spunbond web, may be employed as the carrier sheet to provide graphic images visible from the loop side of the finished product. This can be advantageous, for example, for loop materials to be used on children's products, such as disposable diapers. In such cases, child-friendly graphic images can be provided on the loop material that is permanently bonded across the front of the diaper chassis to form an engagement zone for the diaper tabs. The image can be pre-printed on either surface of the carrier sheet, but is generally printed on the loop side. An added film may alternatively be pre-printed to add graphics, particularly if acceptable graphic clarity cannot be obtained on a lightweight spunbond carrier.

Figure 6:
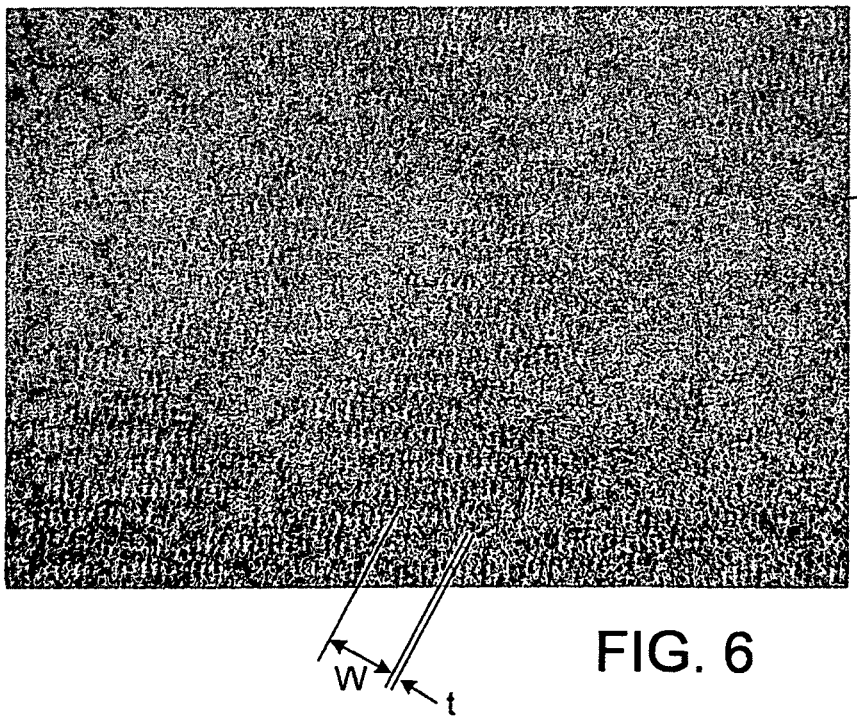
FIG. 6 is a photo of a loop material having an embossed pattern on its loop-carrying surface.

FIG. 6 shows a finished loop product, as seen from the loop side, embossed with a honeycomb pattern 58. Various other embossing patterns include, as examples, a grid of intersecting lines forming squares or diamonds, or a pattern that crushes the loop formations other than in discrete regions of a desired shape, such as round pads of loops. The embossing pattern may also crush the loops to form a desired image, or text, on the loop material. As shown in FIG. 6, each cell of the embossing pattern is a closed hexagon and contains multiple discrete loop structures. The width 'W' between opposite sides of the open area of the cell is about 6.5 millimeters, while the thickness 't' of the wall of the cell is about 0.8 millimeter.

The above-described processes enable the cost-effective production of high volumes of loop materials with good fastening characteristics. They can also be employed to produce loop materials in which the materials of the loops, substrate and optional backing are individually selected for optimal qualities. For example, the loop fiber material can be selected to have high tenacity for fastening strength, while the substrate and/or backing material can be selected to be readily bonded to other materials without harming the loop fibers.

The materials of the loop product can also be selected for other desired properties. In one case the loop fibers, carrier web and backing are all formed of polypropylene, making the finished loop product readily recyclable. In another example, the loop fibers, carrier web and backing are all of a biodegradable material, such that the finished loop product is more environmentally friendly. High tenacity fibers of biodegradable polylactic acid are available, for example, from Cargill Dow LLC under the trade name NATUREWORKS.

Polymer backing layers or binders may be selected from among suitable polyethylenes, polyesters, EVA, polypropylenes, and their co-polymers. Paper, fabric or even metal may be used. The binder may be applied in liquid or powder form, and may even be pre-coated on the fiber side of the carrier web before the fibers are applied. In many cases, a separate binder or backing layer is not required, such as for low cycle applications in disposable personal care products, such as diapers.

A number of embodiments of the invention have been described. Nevertheless, it will be understood that various modifications may be made without departing from the spirit and scope of the invention. Accordingly, other embodiments are within the scope of the following claims.

What is claimed is:

1. A method of making a sheet-form hook-engageable loop product, the method comprising placing a layer of staple fibers on a first side of a substrate, the substrate comprising a nonwoven web;

needling fibers of the layer through the nonwoven web by penetrating the substrate with needles that drag portions of the fibers through the nonwoven web during needling, leaving exposed loops of the fibers extending from a second side of the substrate; and anchoring fibers forming the loops to the nonwoven web, wherein anchoring the fibers to the nonwoven web comprises laminating the fibers to the nonwoven web by applying heat and pressure to the fibers and the nonwoven web, wherein the layer of staple fibers placed on the nonwoven web has a total fiber weight of less than about 2 ounces per square yard (67 grams per square meter), and the hook-engageable loop product has an overall weight of less than about 5 ounces per square yard (167 grams per square meter), wherein the fibers are loose and unbonded to the nonwoven web and each other until needled.

2. The method of claim 1 wherein the fibers include bicomponent fibers having a core of one material and a sheath of another material, and wherein anchoring the fibers comprises melting material of the sheaths of the bicomponent fibers to bind fibers together.

3. The method of claim 1 wherein anchoring the fibers to the substrate comprises laminating the fibers to the substrate by applying heat and pressure to the fibers and the substrate.

4. The method of claim 3 wherein the heat and/or the pressure is applied by a roll having a compliant outer surface.

5. The method of claim 3 wherein the fibers are loose and unconnected to the substrate and each other until needled.

6. The method of claim 1 wherein needling fibers of the layer through the substrate and anchoring fibers forming the loops forms loops sized and constructed to be releasably engageable by a field of hooks for hook-and-loop fastening.

7. The method of claim 1 wherein the staple fibers are disposed on the substrate in a layer of a total fiber weight of no more than about one ounce per square yard (34 grams per square meter).

8. The method of claim 1 wherein the staple fibers are disposed on the substrate in a carded, unbonded state.

9. The method of claim 1 further comprising, prior to disposing the fibers on the substrate, carding and cross-lapping the fibers.

10. The method of claim 1 wherein the needles are forked needles having a 25 gauge or smaller diameter.

11. The method of claim 1 wherein the substrate and the fibers consist essentially of a single recyclable base resin.

12. The method of claim 11 wherein the substrate and the fibers consist essentially of polypropylene.

13. The method of claim 1 wherein anchoring the fibers forming the loops to the nonwoven web comprises placing a binder on the fibers on the first side of the substrate, and then fusing the substrate and/or the fibers to the binder.

14. The method of claim 13 wherein the binder is in powder form prior to being fused.

15. The method of claim 13 wherein the binder comprises a sheet of film.

16. The method of claim 15 wherein the sheet of film is heated prior to being placed on the fibers.

17. The method of claim 1 wherein the overall thickness of the sheet-form loop product is less than about 0.1 inch.

18. The method of claim 4 wherein the roll is heated to a temperature of about 350 to about 400 degrees Fahrenheit.

19. The method of claim 1 wherein the weight of the nonwoven web is about 0.35 to about 0.50 ounces per square yard (about 12 to about 17 grams per square meter).

20. The method of claim 1 wherein the needling of fibers has an overall penetration density of 110-160 punches per square centimeter.

* * * * *